United States Patent [19]

Munt, III et al.

[11] Patent Number: 4,796,827

[45] Date of Patent: Jan. 10, 1989

[54] COMBINATION KITE CONTROL AND REEL DEVICE

[76] Inventors: Dean J. Munt, III; Nancy J. Munt, both of 27665 Estepona, Mission Viejo, Calif. 92630

[21] Appl. No.: 89,560

[22] Filed: Aug. 26, 1987

[51] Int. Cl.[4] ..... B65H 75/40; B64C 31/06

[52] U.S. Cl. ..... 242/96; 244/155 A

[58] Field of Search ..... 242/96, 106, 60, 61, 242/62, 67.1 R; 244/155 A

[56] References Cited

U.S. PATENT DOCUMENTS

| | | | |
|---|---|---|---|
| 2,029,427 | 2/1936 | Klau | 242/61 |
| 3,838,830 | 10/1974 | Pettit | 242/96 |
| 4,129,273 | 12/1978 | Hill | 242/96 X |
| 4,293,104 | 10/1981 | Guim | 242/96 |

FOREIGN PATENT DOCUMENTS

| | | | |
|---|---|---|---|
| 1528704 | 10/1978 | United Kingdom | 242/96 |
| 1544479 | 4/1979 | United Kingdom | 242/96 |

*Primary Examiner*—John M. Jillions

*Attorney, Agent, or Firm*—Francis X. LoJacono

[57] ABSTRACT

A manually controlled kite reel for controlling and operating one or more kites, and more particularly a kite reel arranged to support one or more line spools. The device provides a handle having an offset axle to rotatably support a drive spindle having a drive bar with a centrally disposed hole to receive the axle of the handle, the drive spindle including a pair of oppositely disposed line-spool-support pins wherein one of said support pins defines a crank arm for rotating the drive spindle. A line guide is provided and formed with the handle as an extended line-guide arm having a plurality of notches disposed therein and arranged so as to be in alignment with the respective positioned line spool on the drive spindle.

10 Claims, 2 Drawing Sheets

COMBINATION KITE CONTROL AND REEL DEVICE

BACKGROUND OF THE INVENTION

1. Field of the Invention

The present invention relates generally to a manually controlled, kite-reel device and more particularly to a dual-line, stunt-kite-control device that is arranged having dual-line control spools removably mounted to a drive spindle which is rotatably attached to a drive handle.

2. Descrpition of the Prior Art

As is well known in the art, there are numerous types of kite reels and control devices. However, there are few kite-reel devices that address the problems that are inherent when one flies a two-string stunt kite.

Such known devices can range from wood or plastic dowels to expensive and complicated reels that would be more suitable with a fish on the end of the line rather than a kite.

As examples of known kite reels, one may look to the range of reel structures as disclosed in the following issued United States patents.

There is disclosed in U.S. Pat. No. 3,593,940 to Elbert Stanton a power-driven, kite-string reel which is only suitable as a single-string control unit and does not allow stunt flying.

In U.S. Pat. No. 3,822,839 to Dominic J. Persichini, there is disclosed another power-driven, kite-string reel having a motor and speed-reduction, gear-mounting box for mounting a connected reversible motor. Here too, this device is not suitable for dual-string-control stunt kites.

U.S. Pat. No. 4,101,090 to Albert L. Wait, Jr., discloses a reel structure for retrieving and discharging a single control line having more than one hub for storing the line. The hubs are concentrically aligned with a dividing plate captured between them and a radial slot in the plate with which the line can be transferred between the hubs as it is retrieved. This unit is manually operated and includes means for steadying the reel structure against the body of the operator.

In U.S. Pat. No. 4,129,273 to Donald R. Hill, there is provided a kite-control mechanism arranged to control a plurality of kite-flying lines. The mechanism includes a pair of spools mounted in a frame by a control shaft having a manually operable handle. The spools may be driven from the mounting shaft by a key thereon selectively engaging keyways in the respective spools so as to premit driving of both spools concurrently or one spool independently of the other when desired. The spools are not removable from their frame structures.

Another kite-reel device, disclosed in U.S. Pat. No. 4,172,567 to Ferdinand J. Post, comprises an elongated shaft having one or more slidably mounted reels thereon. The reels can not be removed for independent control of the respective lines.

U.S. Pat. No. 4,493,461 to Jose R. Polanco et al discloses a kite reel for controlling a single line including a handle having a transverse aperture near the top, an axle fixed at one end within the aperture of the handle, a spool rotatably mounted onto the axle, a knob for rotating the spool about the axis of the axle as the line is wound and unwound from the spool, and a device for stopping rotation of the spool about the axis of the axle.

All of the above patents have various limitations not found in the present invention.

SUMMARY OF THE INVENTION

It is an important object of the present invention to provide a dual-string-control device for stunt kites having two line-control spools removably mounted to a drive spindle which is mounted to a drive handle. The control spools are removed from the drive spindle and are hand-held while the kite is airborne. Once the kite is landed, the spools are reattached to the drive spindle which is at that time rotated to rewind the two lines simultaneously.

Accordingly, another object of the invention is to provide a kite-control device having a drive spindle on which two spools are mounted to unwind the respective lines of a kite or kites independently of each other, and retrieve them simultaneously, thereby performing a dual function unique to the present device.

Another object of the present invention is to provide a device of this character wherein the spools allow the flyer the ability to launch the kite or kites from one position without the need for unreeling and laying out the lines prior to launching the kite or kites.

It is still another object of the present invention to provide line spools which define flight-control handles that allow the flyer to precisely feel the line.

A further object is to provide a device of this character that protects the flyer against line burns by providing line spools that keep the kite line away from the flyer's hands during unreeling and flight operations.

A further object of the present invention is to provide a kite-control device that includes a handle and drive consisting of two pieces, thus providing by simplicity the utmost in ease of operation and reliability.

Still another object of the present invention is to provide a device of this type that is extremely lightweight, yet durable and easily carried.

It is another object of the invention to provide a device of this character that is simple and rugged in construction, has few operating parts, and thus is easy to service and maintain.

The various features of novelty which characterize the invention are pointed out with particularity in the claims annexed to and forming a part of this disclosure. For a better understanding of the invention, its operating advantages by its use, reference should be had to the accompanying drawings and descriptive matter in which there are illustrated and described the preferred embodiment of the invention.

BRIEF DESCRIPTION OF THE DRAWINGS

Referring more particularly to the accompanying drawings, which are for illustrative purposes only, wherein like reference numerals refer to like parts therein.

DETAILED DESCRIPTION OF THE PREFERRED EMBODIMENT

Figure 1:
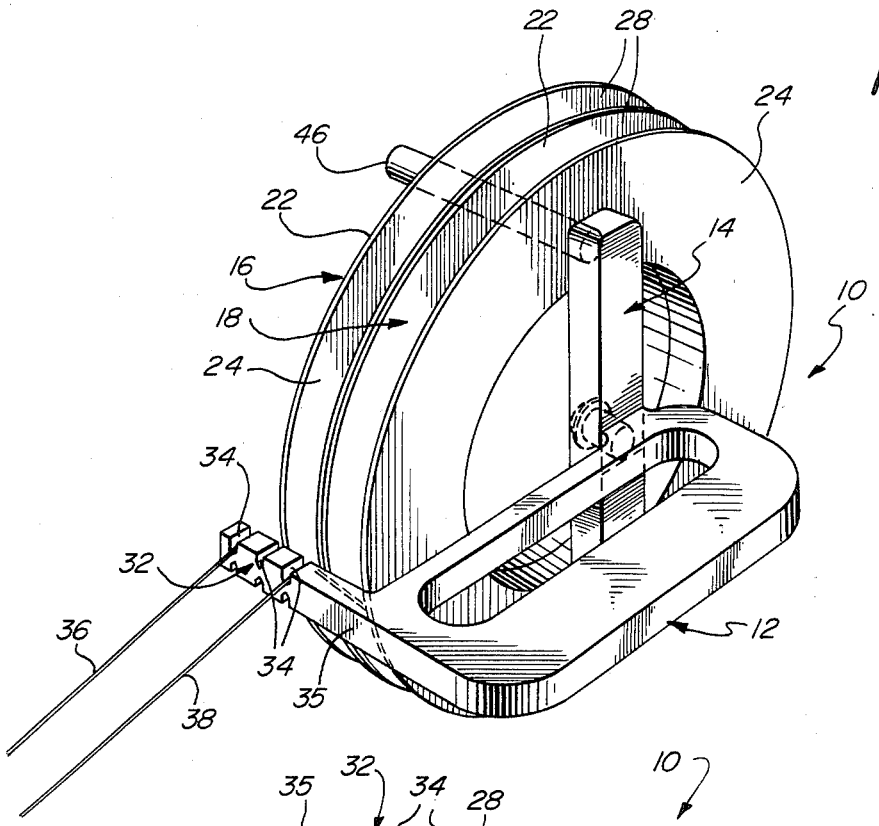
FIG. 1 is a perspective view of a dual-line-control device for use with stunt-kite flying or the flying of two individual kites simultaneously.

Referring now to the drawings, and more particularly to FIG. 1, there is shown the entire assembled dual-line-control device, generally indicated at 10. The control device comprises a drive handle, associated at 12, to which a drive spindle 14 is rotatably mounted, the drive spindle being adapted to removably receive a pair of line spools 16 and 18. It should be noted that line spools 16 and 18 are shown in their normal circular configuration. However, they may be formed having other configurations such as an oval shape wherein each spool is formed having a large opening 20 which is located concentric to the spool.

Figure 2:
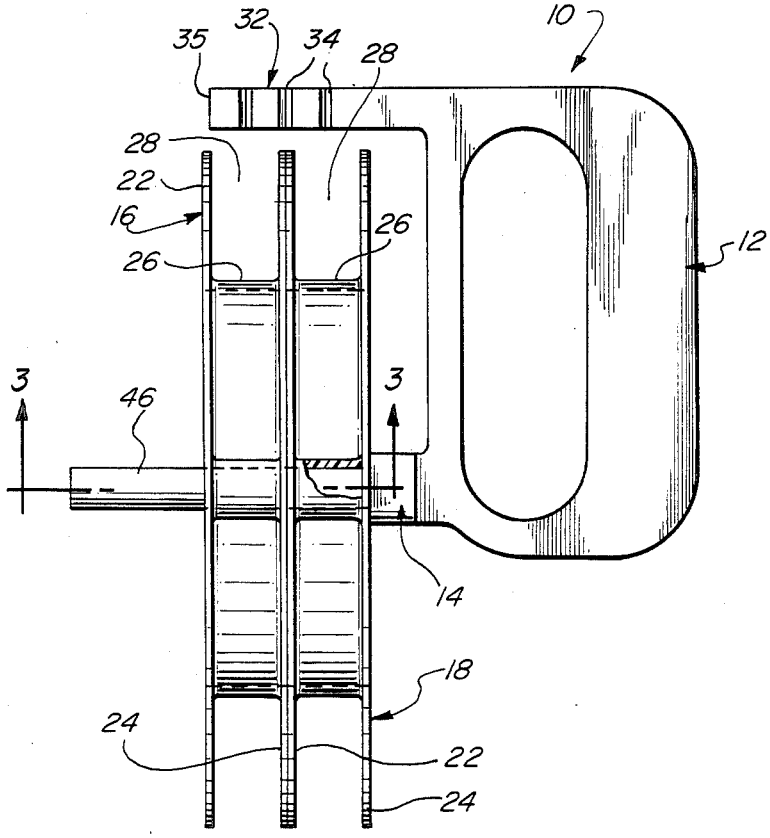
FIG. 2 is a top-plan view with a portion of one spool broken away.
Figure 3:
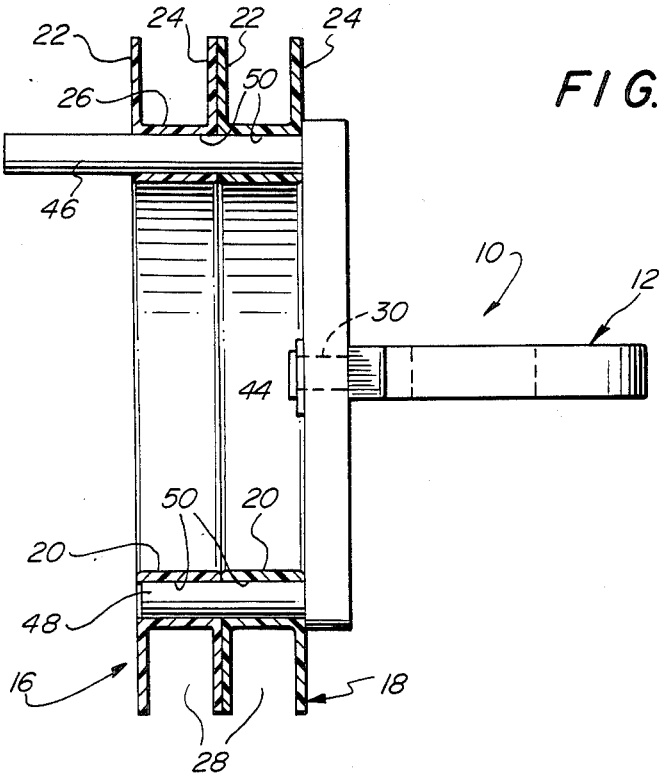
FIG. 3 is a cross-sectional view taken substantially along line 3—3 of FIG. 2.
Figure 4:
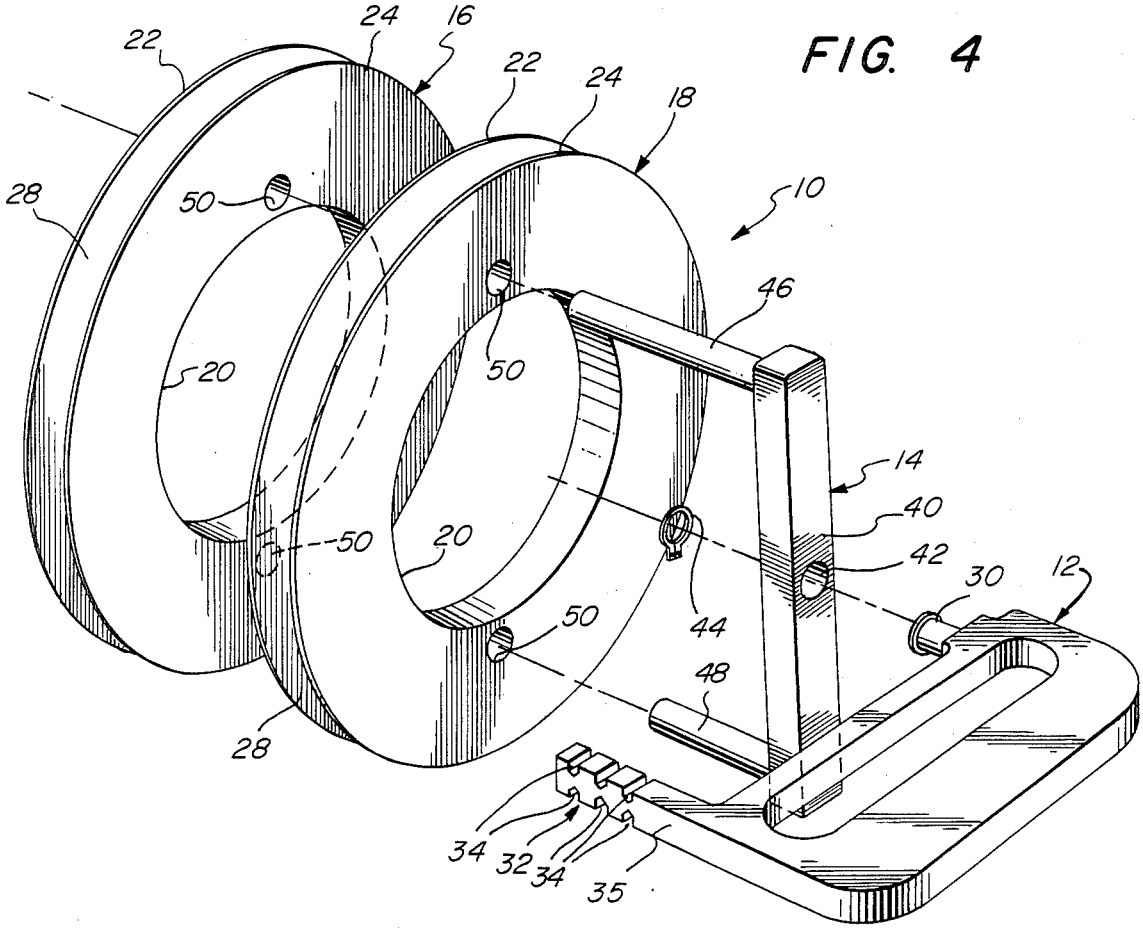
FIG. 4 is an exploded perspective view showing the two spools separated from the drive spindle.

Each spool 16 and 18 is further comprised of a pair of side walls 22 and 24 together with an annular wall 26 defining an annular channel 28. The channel may be formed in several shapes such as a "V" shaped or, as indicated in FIG. 2, a "U" shaped configuration. Spools 16 and 18 are arranged to be removably mounted to drive handle 12.

Handle 12 includes means for rotataly supporting spindle 14 wherein the means comprises a pin 30 defining an axle integrally formed therewith and offset adjacent one end of the handle. The opposite end of handle 12 includes a guide means, generally indicated at 32, defined by a plurality of notches 34 formed in an extended arm member 35. As seen in FIG. 1, notches 34, particularly the outer positioned notches, are aligned with the respective spools, whereby lines 36 and 38 are received therein.

Accordingly, drive spindle 14 comprises a drive bar 40 having a centrally disposed bore 42 adapted to receive mounting pin 30. The drive spindle is positioned on pin 30 and is rotatably secured by a securing means which is herein shown as being a clip ring 44. However, other suitable means may be employed. Drive bar 40 is also formed having spool-support pins 46 and 48. Hence, each spool 16 and 18 includes oppositely disposed bores 50 through which the respective spool-support pins 46 and 48 are received. Pin 46 further defines a crank handle by which spindle 14 is rotated, thus turning spools 16 and 18 when reeling in lines 36 and 38. Once lines 36 and 38 are unreeled, they are removed from support pins 46 and 48, and are then held in each hand by the operator thereof.

After flying the kite (note shown), the kite or kites are landed, at which time the spools are repositioned on support pins 46 and 48. Handle 12 is held in one hand by the operator and spindle 14 is rotated by the other hand of the operator, whereupon lines 36 and 38 are reeled back into the respective channels 28.

The foregoing is a description of a preferred embodiment of the invention which is given here by way of example only. The invention is not to be taken as limited to any of the specific features as described, but comprehends all such variations thereof as come within the scope of the appended claims.

What we claim is:

1. A dual-line, hand-held, kite-control device, comprising:

a handle means including an axle pin integrally formed therewith;

a drive spindle rotatably mounted to said axle pin;

said drive spindle including means for rotating said drive spindle about said axle pin;

a pair of line spools removably mountable to said drive spindle whereby said line spools are hand-held in each hand of an operator thereof when said line spools are removed from said drive spindle;

means for removably mounting said line spools to said drive spindle; and guide means formed on said handle means whereby lines from said line spools mounted on said drive spindle are guided back onto said line spools as said drive spindle is rotated.

2. A kite-control device as recited in claim 1, wherein said drive spindle comprises:

a drive bar having a centrally disposed bore for receiving said axle pin therein;

a first support pin affixed adjacent to one end of said drive bar;

a second support pin affixed at the opposite end of said drive bar; and a pair of transverse bores disposed in said line spools and positioned to receive said first and second support pins therethrough.

3. A kite-control device as recited in claim 2, wherein said means for rotating said drive spindle is defined by said first support pin.

4. A kite-control device as recited in claim 2, wherein each of said line spools is formed having a centrally disposed opening, whereby each spool is held in the hand of the operator thereof when said spools are removed from said drive spindle.

5. A kite-control device as recited in claim 4, wherein said line spools include an annular channel for storage of said line thereon.

6. A kite-control device as recited in claim 4, wherein said guide means comprises:

an extended arm member formed as part of said drive handle; and a plurality of notches formed in said arm member to receive respective lines therein.

7. A hand-held, kite reel device for independently discharging, controlling and simultaneously retrieving one or more lines connected to a kite or kites, comprising:

a holding means including an axle pin;

a drive spindle rotatably mounted to said axle pin by a centrally disposed hole formed in said drive spindle;

means for rotating said drive spindle, said rotating means being affixed to said drive spindle;

a pair of line spools removably mounted to said drive spindle; said spools including transverse bores for removably mounting said spools on said drive spindle; and means for removably mounting said line spools to said drive spindle, said means being formed as part of said drive spindle whereby said spools are removable from said drive spindle so as to be held in each hand of the operator thereof.

8. A kite-reel device as recited in claim 7, wherein said drive spindle comprises:

a drive bar in which said hole is formed;

a first support pin mounted to said drive bar adjacent one end thereof; and a second support pin mounted to said drive bar adjacent the opposite end thereof, wherein bores of said spools are positioned to receive respective first and second support pins, whereby said spools are rotatable with said drive spindle for discharging and retrieving one or more lines attached to said spools.

9. A kite-reel device as recited in claim 8, wherein said holding means comprises a handle including line-guide means.

10. A kite-reel device as recited in claim 9, wherein said line-guide means comprises an extended arm member mounted to said handle, a plurality of notches being formed in said arm member to receive the respective line or lines when retrieving said line or lines.

* * * * *